US012601512B2

(12) United States Patent
Liang

(10) Patent No.: US 12,601,512 B2
(45) Date of Patent: Apr. 14, 2026

(54) HUMIDIFYING DEVICE AND HUMIDIFYING METHOD FOR AIR-CONDITIONING UNIT

(71) Applicant: LINYI UNIVERSITY, Linyi (CN)

(72) Inventor: Ruquan Liang, Linyi (CN)

(73) Assignee: Linyi University, Linyi (CN)

( * ) Notice: Subject to any disclaimer, the term of this patent is extended or adjusted under 35 U.S.C. 154(b) by 322 days.

(21) Appl. No.: 18/462,128

(22) Filed: Sep. 6, 2023

(65) Prior Publication Data

US 2025/0075922 A1 Mar. 6, 2025

(51) Int. Cl.

| | |
|---|---|
| ***F24F 6/12*** | (2006.01) |
| ***F24F 6/02*** | (2006.01) |
| *F24F 6/00* | (2006.01) |
| *F24F 11/30* | (2018.01) |

(52) U.S. Cl.

CPC ..... *F24F 6/12* (2013.01); *F24F 6/02* (2013.01); *F24F 2006/008* (2013.01); *F24F 11/30* (2018.01)

(58) Field of Classification Search

CPC ..... F24F 6/12; F24F 6/02; F24F 11/30; F24F 2006/008

See application file for complete search history.

(56) References Cited

U.S. PATENT DOCUMENTS 10,829,913 B1 * 11/2020 Ahmed ..... B01D 61/025
2001/0042381 A1 * 11/2001 Dodo ..... F02C 6/18 62/331
2005/0252027 A1 * 11/2005 Kolari ..... F26B 21/37 34/514
2006/0086120 A1 * 4/2006 Kashirajima ..... F24F 12/003 62/331
2006/0236715 A1 * 10/2006 Nikai ..... F24F 3/1411 62/271

(Continued)

FOREIGN PATENT DOCUMENTS

CN 104748257 A * 7/2015 ..... F24F 13/22
CN 206600874 U * 10/2017

(Continued)

*Primary Examiner* — Stephen Hobson
(74) *Attorney, Agent, or Firm* — Pilloff Passino & Cosenza LLP; Rachel K. Pilloff; Sean A. Passino

(57) ABSTRACT

A humidifying device and a humidifying method for an air-conditioning unit includes a connecting piece, where the connecting piece includes a connecting coiled pipe fixedly connected to an inner wall of a top end of a humidifying cavity, an air inlet end of the connecting coiled pipe extends out of the humidifying cavity to be selectively communicated with an air-conditioner indoor unit or air-conditioner outdoor unit, and an air outlet end of the connecting coiled pipe extends into a flocculating cavity; a flocculating piece arranged in the flocculating cavity, including a flocculating cylinder rotatably connected with the flocculating cavity, where the flocculating cylinder is provided with flocculating holes, one end of the connecting coiled pipe extending into the flocculating cavity is in transmission connection with the flocculating cylinder; a heat exchanging piece arranged in the humidifying cavity includes a supporting shell, supporting holes and a vibrating piece.

10 Claims, 8 Drawing Sheets

(56) References Cited

U.S. PATENT DOCUMENTS

| | | | | |
|---|---|---|---|---|
| 2008/0145731 | A1* | 6/2008 | Sakajo | H01M 8/04014 429/442 |
| 2009/0075581 | A1* | 3/2009 | Van Heeswijk | F24F 5/0035 454/239 |
| 2011/0036116 | A1* | 2/2011 | Lee | F24D 11/0242 62/509 |
| 2016/0327288 | A1* | 11/2016 | Kim | F01K 5/00 |
| 2018/0126323 | A1* | 5/2018 | Peterson | B01D 53/261 |
| 2019/0283548 | A1* | 9/2019 | Saito | B01D 53/04 |
| 2020/0263884 | A1* | 8/2020 | Cao | F24F 13/30 |
| 2021/0114435 | A1* | 4/2021 | Gergis | B60H 1/00485 |
| 2022/0186972 | A1* | 6/2022 | Kim | F24F 3/1405 |
| 2025/0075922 | A1* | 3/2025 | Liang | F24F 6/02 |
| 2026/0043555 | A1* | 2/2026 | Ku | F24F 6/00 |

FOREIGN PATENT DOCUMENTS

| | | | | | |
|---|---|---|---|---|---|
| CN | 109237683 | A | * | 1/2019 | F24F 12/00 |
| CN | 111296297 | A | * | 6/2020 | F28D 5/02 |
| CN | 106765559 | B | * | 8/2020 | F24F 2110/50 |
| CN | 111649407 | A | * | 9/2020 | F24F 13/28 |
| CN | 111678233 | A | * | 9/2020 | B08B 15/04 |
| CN | 113188223 | A | * | 7/2021 | F24F 13/32 |
| WO | WO-2015125249 | A1 | * | 8/2015 | F24F 11/30 |
| WO | WO-2022059428 | A1 | * | 3/2022 | B01D 53/26 |

* cited by examiner

HUMIDIFYING DEVICE AND HUMIDIFYING METHOD FOR AIR-CONDITIONING UNIT

TECHNICAL FIELD

The application belongs to the technical field of energy saving of air-conditioners, and in particular to a humidifying device and a humidifying method for an air-conditioning unit.

BACKGROUND

At present, air-conditioners are widely applied in civil and industrial use, providing a comfortable environment for daily life of people. However, the functions of air-conditioners on market are relatively single, and they are basically used for refrigerating in summer and heating in winter. When these air-conditioning refrigeration systems are working, they continuously release a lot of heat outside, which not only is a great waste of energy, but also aggravates the greenhouse effect.

Moreover, air-conditioners reduce the indoor humidity in the refrigerating or heating process, which affects the experience of people in the area. Therefore, the humidifier is often turned on when the air-conditioner is working, resulting in additional energy consumption.

SUMMARY

The purpose of the present application is to provide a humidifying device for an air conditioning unit and a humidifying method thereof, so as to solve the above problems, effectively combine a humidifier and an air-conditioner, solve the problem of waste of the air-conditioner waste heat by utilizing the air-conditioner waste heat, alleviate the greenhouse effect, reduce the energy consumption caused by additional humidifying, and to improve economic benefits.

In order to achieve the above purpose, the present application provides the following scheme: a humidifying device for an air-conditioning unit, including:

- a humidifying box, where a flocculating cavity and a humidifying cavity are respectively defined in the humidifying box;
- a connecting piece arranged in the humidifying cavity, where the connecting piece includes a connecting coiled pipe fixedly connected to the inner wall of the top end of the humidifying cavity, the air inlet end of the connecting coiled pipe extends out of the humidifying cavity to be selectively communicated with the air-conditioner indoor unit or air-conditioner outdoor unit, and the air outlet end of the connecting coiled pipe extends into the flocculating cavity;
- a flocculating piece arranged in the flocculating cavity, where the flocculating piece includes a flocculating cylinder rotatably connected with the flocculating cavity, the flocculating cylinder is provided with a plurality of flocculating holes, and one end of the connecting coiled pipe extending into the flocculating cavity is in transmission connection with the flocculating cylinder;
- a heat exchanging piece arranged in the humidifying cavity, where the heat exchanging piece is used for exchanging heat between the humidifying cavity and the flocculating cavity, and the heat exchanging piece includes a supporting shell fixedly connected in the humidifying cavity, and the supporting shell is provided with a plurality of supporting holes, and a vibrating piece is arranged in the supporting shell.

Optionally, one end of the connecting coiled pipe extending out of the humidifying cavity is communicated with a first pipeline, and a compressor is arranged on the first pipeline, where the first pipeline is communicated with the air-conditioner indoor unit when the air-conditioning unit refrigerates, and the first pipeline is communicated with the air-conditioner outdoor unit when the air-conditioning unit heats.

Optionally, a side of the flocculating cavity away from the connecting coiled pipe is communicated with a second pipeline, and one end of the second pipeline extends out of the flocculating cavity, where when the first pipeline is communicated with the air-conditioner indoor unit, the second pipeline is communicated with the air-conditioner outdoor unit, and when the first pipeline is communicated with the air-conditioner outdoor unit, the second pipeline is communicated with the air-conditioner indoor unit.

Optionally, a rotating rod is rotatably connected in the flocculating cavity, the flocculating cylinder is fixedly connected to the rotating rod, the rotating rod is provided with a transmission piece corresponding to the connecting coiled pipe, and the transmission piece includes a plurality of spiral blades fixedly connected to the rotating rod in the circumferential direction, the air outlet end of the connecting coiled pipe faces the spiral blades, and a cleaning piece is also arranged in the flocculating cavity, and the cleaning piece is in sliding contact with the flocculating cylinder.

Optionally, the cleaning piece includes sleeves sleeved on the rotating rod, one end of each of sleeves is connected with a control piece in a transmission way, each of the sleeves selectively reciprocates or rotatably rotates with the rotating rod through the control piece, and the outer peripheral sides of the sleeves are in sliding contact with the flocculating cylinder.

Optionally, the supporting shell adopts a columnar structure with a trapezoidal cross section, the plurality of supporting holes are arranged sequentially on both sides of a top end face of the supporting shell. The vibrating piece includes a plurality of ultrasonic plates fixedly connected in the supporting shell, and the ultrasonic plates are arranged in sequence in a direction perpendicular to the rotating rod, and a gap is arranged between two adjacent ultrasonic plates.

Optionally, a partition plate is fixedly connected in the humidifying box, and the humidifying box is separated into the flocculating cavity and the humidifying cavity through the partition plate. The partition plate is of a heat conduction structure. Heat exchanging sheets are fixedly connected to one side of the partition plate close to the humidifying cavity. The supporting shell is correspondingly arranged with the heat exchanging sheets. The connecting coiled pipe is arranged at the top of the supporting shell.

Optionally, one side of the humidifying cavity away from the heat exchanging sheets is provided with a humidifying hole. A filter plate is fixedly connected in the humidifying hole. A water filling inlet is arranged at the bottom end of the humidifying cavity, and a water replenishing pipe is communicated in the water filling inlet.

A humidifying method for an air-conditioning unit, based on the humidifying device for the air-conditioning unit further includes the following steps when the air-conditioning unit refrigerates:

- S1, communicating the first pipeline with the air-conditioner indoor unit, and controlling the flocculating cylinder to rotate and heating an interior of the humidifying cavity by the connecting coiled pipe;

S2, starting the vibrating piece for heat exchange; and

S3, communicating the second pipeline with the air-conditioner outdoor unit and communicating the air-conditioner outdoor unit with the air-conditioner indoor unit.

Optionally, a humidifying method for an air-conditioning unit, based on the humidifying device for the air-conditioning unit further includes the following steps when the air-conditioning unit heats:

S1, communicating the first pipeline with the air-conditioner outdoor unit, and controlling the flocculating cylinder to rotate and heating an interior of the humidifying cavity by the connecting coiled pipe;

S2, starting the vibrating piece for heat exchange; and

S3, communicating the second pipeline with the air-conditioner indoor unit, and communicating the air-conditioner indoor unit with the air-conditioner outdoor unit.

Compared with the prior art, the application has the following advantages and technical effects.

According to the application, the humidifying box is correspondingly communicated with the air-conditioner indoor unit or air-conditioner outdoor unit, the gas with the waste heat energy of the air-conditioner is firstly introduced into the connecting coiled pipe to heat the humidifying cavity for the first time, and then the gas with the waste heat is introduced into the flocculating cavity, through transmission between connecting coiled pipe and the flocculating cylinder, the flocculating cylinder rotates to disperse the introduced gas, so that the flocculating gas is capable of exchanging heat with the humidifying cavity more efficiently, the heat exchange efficiency is improved, the additional energy consumption is reduced, and the use cost is reduced. Then the heat exchanging piece arranged in the humidifying cavity exchanges heat with the flocculating gas in the flocculating cavity, so as to further accelerate the heat exchange recovery of the residual gas of the air-conditioner; combined with the vibrating piece arranged in the supporting shell, the tension required for supporting the humidifying water is reduced by using the supporting holes, and the humidifying water film formed on the supporting holes is fully contacted with the heat absorbed after heat exchange through vibration, so that the utilization efficiency of heat exchange energy is improved, and the heat exchange and humidification effect is enhanced.

BRIEF DESCRIPTION OF THE DRAWINGS

In order to explain the embodiments of the present application or the technical scheme in the prior art more clearly, the drawings needed in the embodiments will be briefly introduced below. Obviously, the drawings in the following description are only some embodiments of the present application. For ordinary people in the field, other drawings may be obtained according to these drawings without paying creative labor.

DETAILED DESCRIPTION OF THE EMBODIMENTS

Figure 1:
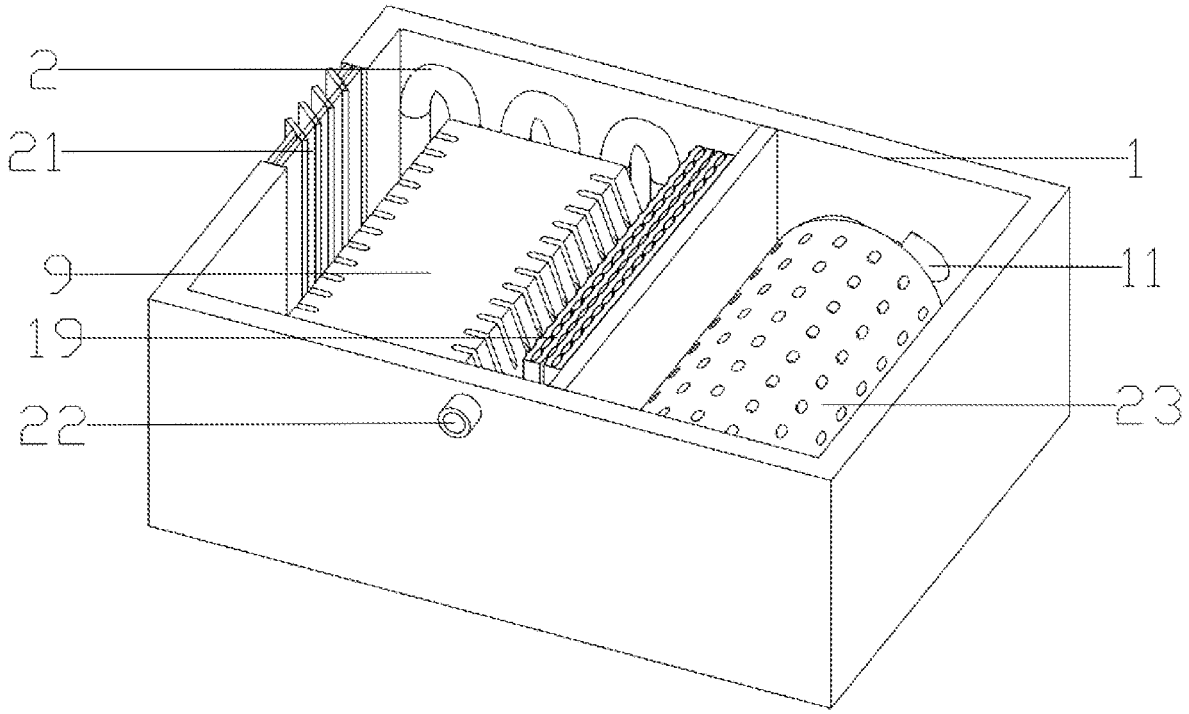
FIG. 1 is an axonometric view of a whole structure.

In the following, the technical scheme in the embodiment of the application will be clearly and completely described with reference to the drawings. Obviously, the described embodiment is only a part of the embodiment of the application, but not the whole embodiment. Based on the embodiments in the present application, all other embodiments obtained by ordinary technicians in the field without creative labor belong to the scope of protection of the present application.

In order to make the above objects, features and advantages of the present application more obvious and easier to understand, the present application will be further described in detail with the attached drawings and specific embodiments.

Embodiment: referring to FIG. 1-FIG. 6, a humidifying device for an air-conditioning unit includes:

a humidifying box 1, where a flocculating cavity 101 and a humidifying cavity 102 are respectively defined in the humidifying box 1;

a connecting piece arranged in the humidifying cavity 102, where the connecting piece includes a connecting coiled pipe 2 fixedly connected to the inner wall of the top end of the humidifying cavity 102, the air inlet end of the connecting coiled pipe 2 extends out of the humidifying cavity 102 to selectively communicate with the air-conditioner indoor unit 3 or air-conditioner outdoor unit 4, and the air outlet end of the connecting coiled pipe 2 extends into the flocculating cavity 101;

a flocculating piece arranged in the flocculating cavity 101, where the flocculating piece includes a flocculating cylinder 23 rotatably connected with the flocculating cavity 101, the flocculating cylinder 23 is provided with a plurality of flocculating holes, and one end of the connecting coiled pipe 2 extending into the flocculating cavity 101 is in transmission connection with the flocculating cylinder 23;

a heat exchanging piece arranged in the humidifying cavity 102, where the heat exchanging piece is used for exchanging heat between the humidifying cavity 102 and the flocculating cavity 101. The heat exchanging piece includes a supporting shell 9 fixedly connected in the humidifying cavity 102, and the supporting shell 9 is provided with a plurality of supporting holes, and a vibrating piece is arranged in the supporting shell 9.

Referring to FIG. 1-FIG. 4, according to the present application, the humidifying box 1 is correspondingly communicated with the air-conditioner indoor unit 3 or air-conditioner outdoor unit 4, and the gas with waste heat energy of the air-conditioner is first introduced into the connecting coiled pipe 2 to heat the humidifying cavity 102 for the first time, and then the gas with waste heat is introduced into the flocculating cavity 101, through the transmission between the connecting coiled pipe 2 and flocculating cylinder 23, flocculating cylinder 23 rotates to disperse the introduced gas, so the flocculating gas is capable of exchanging heat with the humidifying cavity 102 more efficiently. And at the same time, the additional energy consumption is reduced and the use cost is reduced. Then, the heat exchanging piece arranged in the humidifying cavity 102 exchanges heat with the flocculating gas in the flocculating cavity 101, so as to further accelerate the heat exchange recovery of the waste heat gas of the air-conditioner; combined with the vibrating piece arranged in the supporting shell 9, the tension required for supporting the humidifying water is reduced by using the supporting holes, and the humidifying water film formed on the supporting holes is fully contacted with the heat absorbed after heat exchange through vibration, so that the utilization efficiency of heat exchange energy is improved, and the energy consumption is enhanced.

In an embodiment, one end of the connecting coiled pipe 2 extending out of the humidifying cavity 102 is communicated with a first pipeline 5, and a compressor 7 is arranged on the first pipeline 5. The first pipeline 5 is communicated with the air-conditioner indoor unit 3 when the air-conditioning unit refrigerates, and the first pipeline 5 is communicated with the air-conditioner outdoor unit 4 when the air-conditioning unit heats.

In an embodiment, the side of the flocculating cavity 101 away from the connecting coiled pipe 2 is communicated with a second pipeline 6, and one end of the second pipeline 6 extends out of the flocculating cavity 101. When the first pipeline 5 is communicated with the air-conditioner indoor unit 3, the second pipeline 6 is communicated with the air-conditioner outdoor unit 4, while when the first pipeline 5 is communicated with the air-conditioner outdoor unit 4, the second pipeline 6 is communicated with the air-conditioner indoor unit 3.

Figure 2:
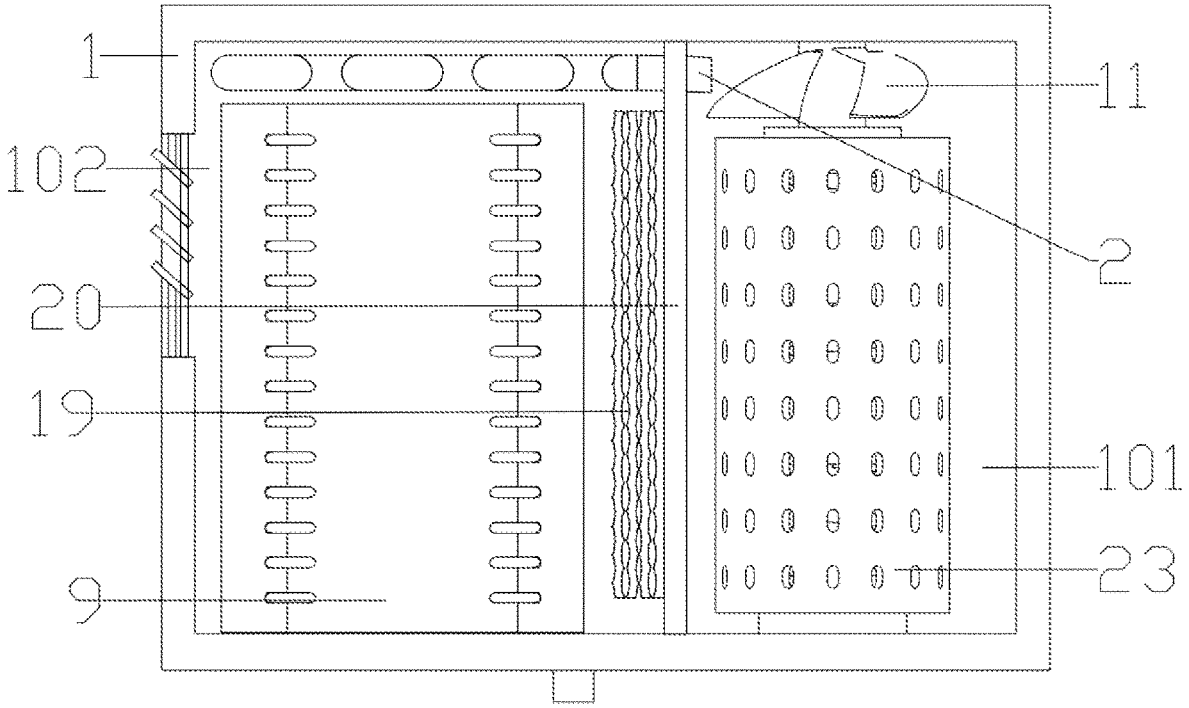
FIG. 2 is a top view of a structure in FIG. 1.
Figure 5:
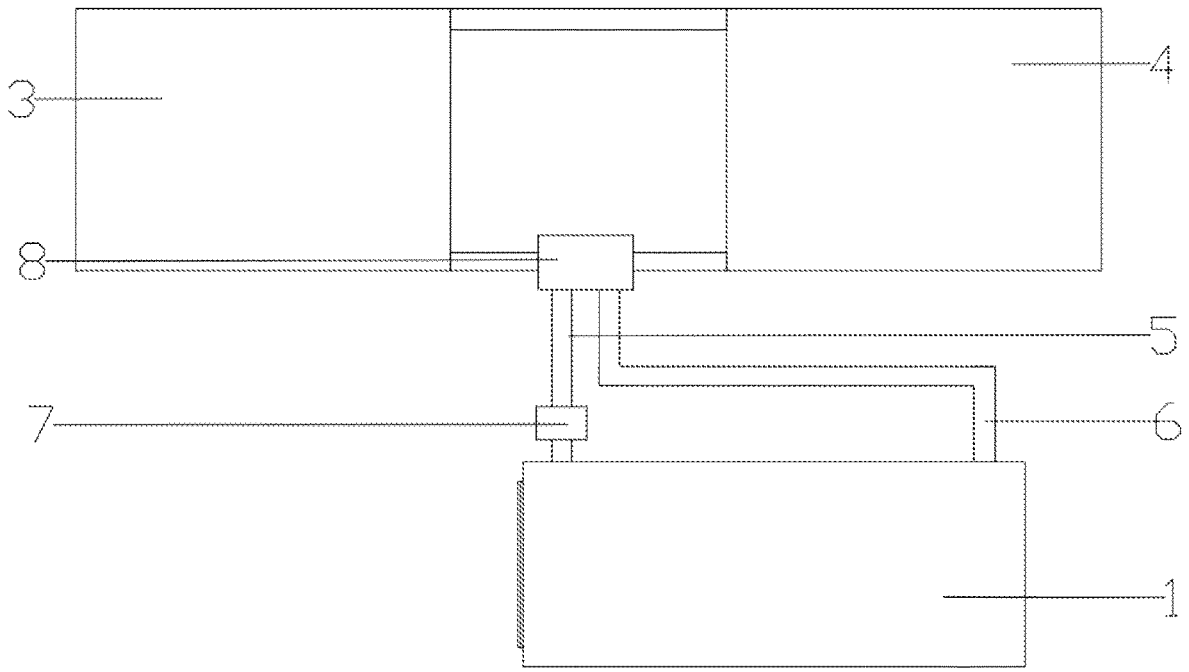
FIG. 5 is a diagram showing a connection relationship between a humidifying box and an air-conditioning unit.
Figure 6:
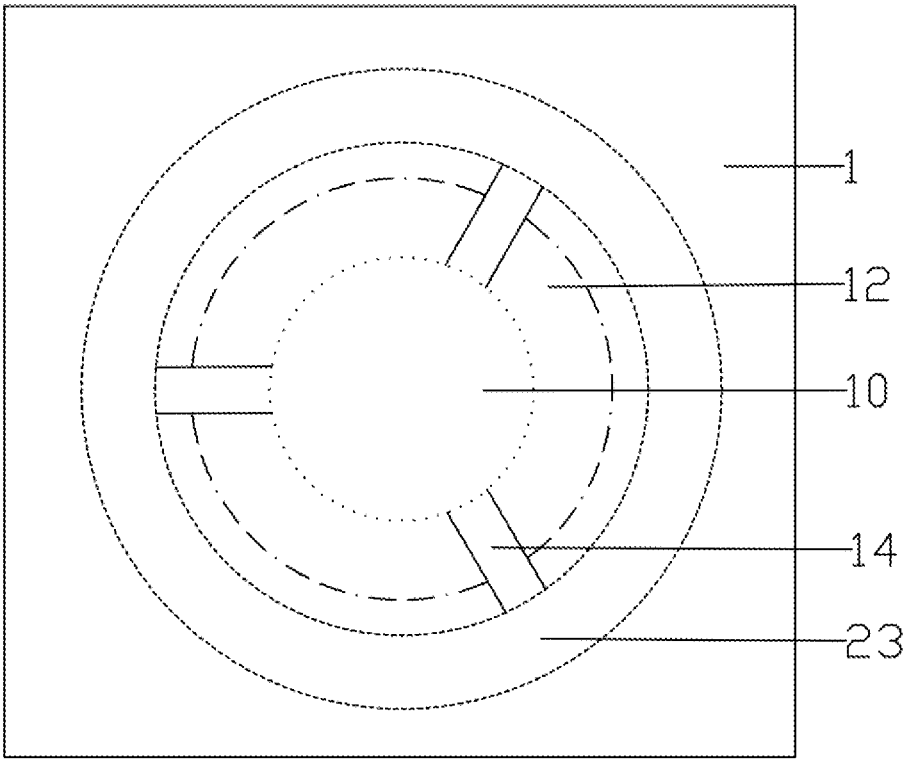
FIG. 6 shows a connection relationship between a rotating rod and a flocculating cylinder.

Referring to FIG. 1, FIG. 2 and FIG. 5, in this technical scheme, the compressor 7 is used to increase the pressure of the gas introduced into the connecting coiled pipe 2 to form a high-temperature and high-pressure refrigerant. When the air-conditioner is refrigerating, through communicating the first pipeline 5 and the air-conditioner indoor unit 3, the evaporator in the air-conditioner indoor unit 3 is used to introduce the high-temperature and high-pressure refrigerant into the first pipeline 5, and then high-temperature and high-pressure refrigerant enters the connecting coiled pipe 2 after passing through the compressor 7. As the connecting coiled pipe 2 is arranged on the inner wall of the top end of the humidifying cavity 102, the humidifying cavity 102 is heated. At the same time, the high-pressure gas flowing out of the connecting coiled pipe 2 is introduced into the flocculating cavity 101, and the gas is fully flocculated by the rotating flocculating cylinder 23, and the separated heat is absorbed into the humidifying cavity 102 by combining with the heat exchanging piece, so that the moisture in the humidifying cavity 102 is heated to generate steam for humidifying, and the gas after absorbing the waste heat is introduced into the air-conditioner outdoor unit 4 through the second pipeline 6, and the residual heat is released through the condenser in the air-conditioner outdoor unit 4, and finally is introduced into the air-conditioner indoor unit 3 for circulating refrigeration.

When the air-conditioner is heating, the condenser in the air-conditioner outdoor unit 4 is communicated with the connecting coiled pipe 2, and high-temperature and high-pressure refrigerant is introduced into the flocculating cavity 101 through the compressor 7, and the heat in the high-pressure gas is used for indoor humidification by repeating the above steps, and then the gas is introduced into the evaporator in the air-conditioner indoor unit 3 through the second pipeline 6 to release the residual heat, so as to circularly heat the room.

In an embodiment, a rotating rod 10 is rotatably connected in the flocculating cavity 101. A flocculating cylinder 23 is fixedly connected to the rotating rod 10, and the rotating rod 10 is provided with a transmission piece corresponding to the connecting coiled pipe 2. The transmission piece includes a plurality of spiral blades 11 fixedly connected to the rotating rod 10 in the circumferential direction. The air outlet end of the connecting coiled pipe 2 faces the spiral blades 11, and a cleaning piece is also arranged in the flocculating cavity 101, and the cleaning piece is in sliding contact with the flocculating cylinder 23.

In an embodiment, the cleaning piece includes sleeves 12 sleeved on the rotating rod 10. One end of each of sleeves 12 is connected with a control piece in a transmission way, and each of sleeves 12 selectively reciprocates or rotatably connects with the rotating rod 10 through the control piece. The outer peripheral sides of the sleeves 12 are in sliding contact with the flocculating cylinder 23.

The high-pressure and high-temperature gas introduced into the connecting coiled pipe 2 releases energy to the flocculating flow of the high-temperature gas through the flocculating cylinder 23, and at the same time, the spiral blades 11 correspond to the high-pressure gas, and the spiral blades 11 is driven by the power of the high-temperature gas to rotate. The rotating rod 10 rotates when the spiral blades 11 rotate. Moreover, connecting rods 14 are arranged between the inner wall surface of the flocculating cylinder 23 and the rotating rod 10, and the flocculating cylinder 23 is fixedly connected with the rotating rod 10 through the connecting rods 14. The output shaft of an external driving motor (not shown in the figure) is in transmission connection with the sleeves 12 to drive the sleeves 12 to be connected with the rotating rod 10, and the outer peripheral sides of the sleeves 12 are fixedly connected with a brush to be in sliding contact with the flocculating cylinder 23, so that the holes of the flocculating cylinder 23 are kept clean and the flocculating effect is improved.

Figure 3:
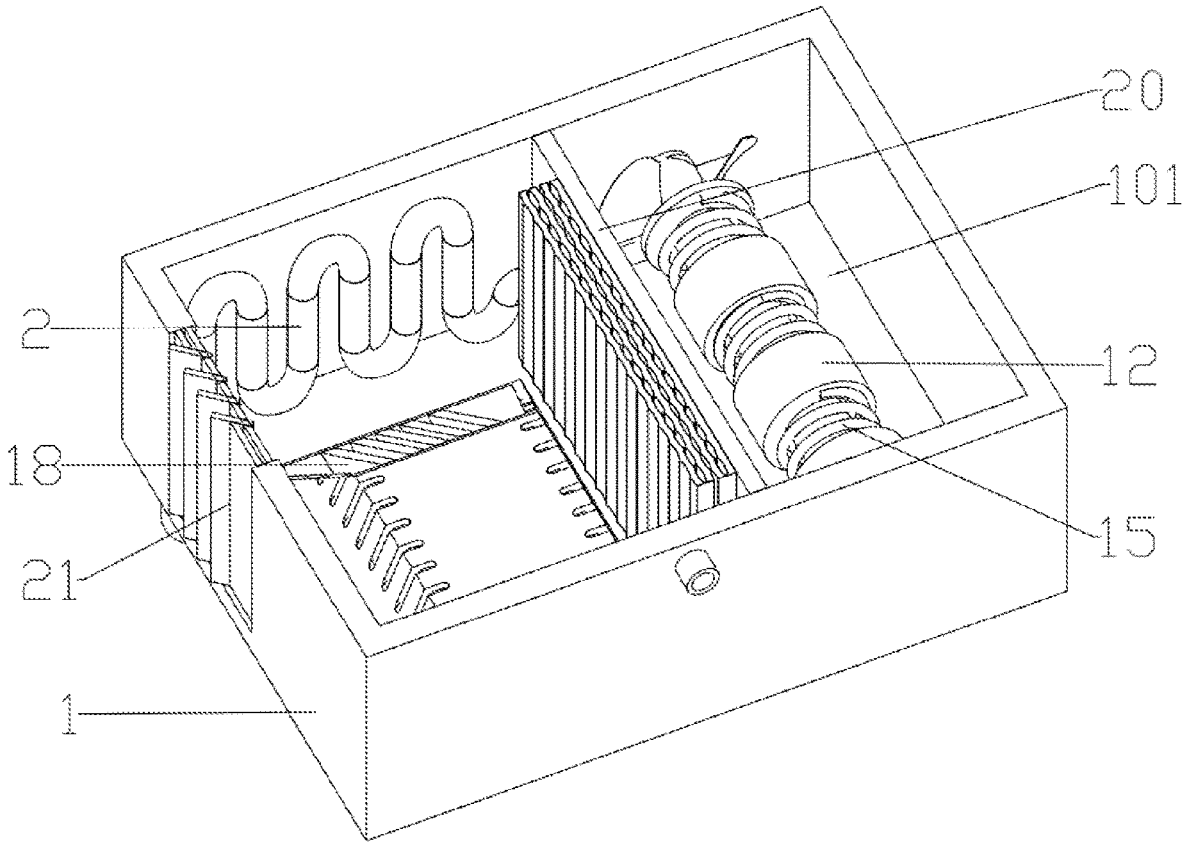
FIG. 3 is a sectional view of a supporting shell and a structural schematic diagram of sleeves.
Figure 4:
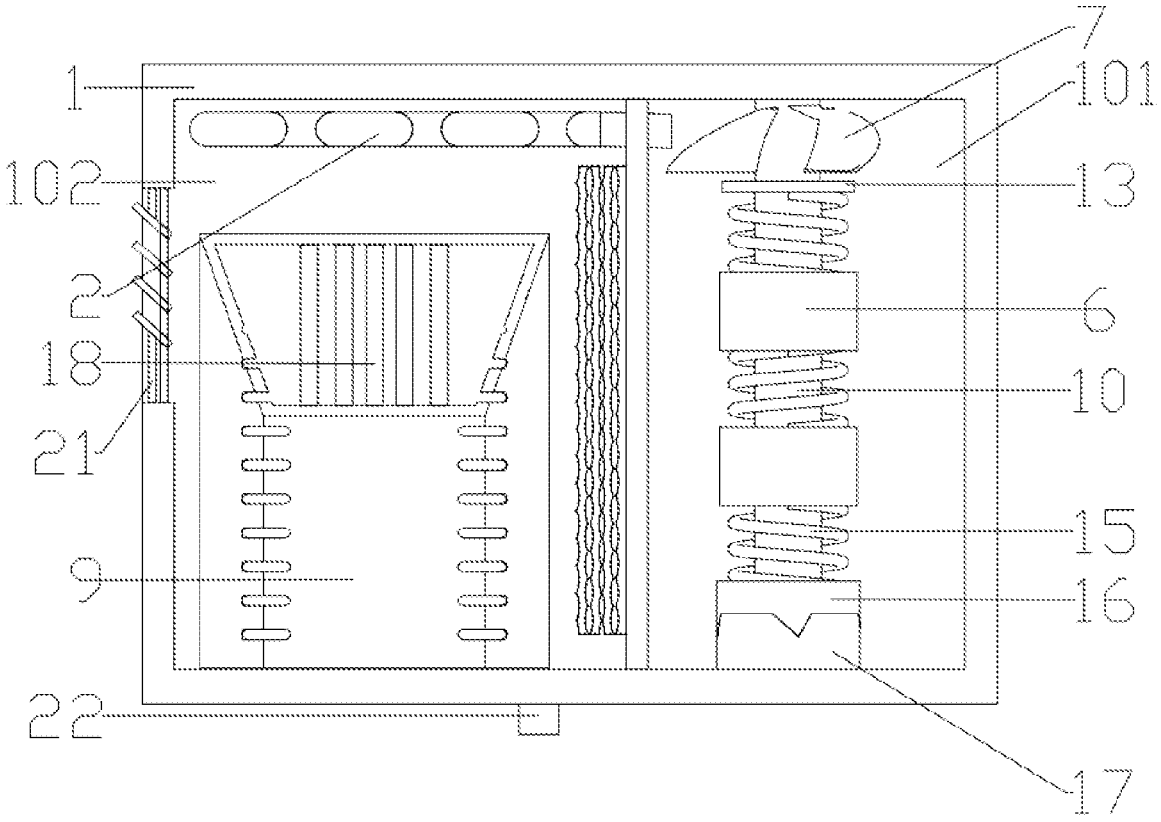
FIG. 4 is a top view of a structure of FIG. 3.

In one embodiment of the technical scheme, referring to FIG. 3 and FIG. 4, a transmission seat 17 is fixedly connected to one side of the inner wall surface of the flocculating cavity 101, a wedge-shaped groove is formed in the transmission seat 17, and a supporting seat 16 is engaged with the transmission seat 17, and the supporting seat 16 is in sliding contact with the transmission seat 17. By fixedly connecting the limit plate 13 to the rotating rod 10 and arranging a plurality of sleeves 12, transmission springs 15 are arranged between the limit plate 13 and the sleeve 12 adjacent to the limit plate 13 and between the adjacent sleeves 12, and transmission springs 15 are fixedly connected between the sleeve 12 adjacent to the supporting seat 16 and the supporting seat 16. When the limit plate 13 is rotated by the rotating rod 10, the limit plate 13 drives the sleeves 12 and the supporting seat 16 to rotate, and the supporting seat 16 continuously engages and slides with the transmission seat 17 as the supporting seat 16 rotates, thus realizing the reciprocating lifting of the supporting seat 16 along the rotating rod 10. The transmission springs 15 are used to improve the lifting transmission force and realize the reciprocating sliding of the sleeves 12. When the sleeves 12 slide to clean the flocculating cylinder 23, the reciprocating sleeves 12 stir the high-temperature gas, thus improving the heat exchange effect.

In an embodiment, the supporting shell 9 adopts a columnar structure with a trapezoidal cross section, and a plurality of supporting holes are arranged sequentially on both sides of a top end face of the supporting shell 9. The vibrating piece includes a plurality of ultrasonic plates 18 fixedly connected in the supporting shell 9, and the ultrasonic plates 18 are arranged in sequence in a direction perpendicular to the rotating rod, and a gap is arranged between two adjacent ultrasonic plates 18.

The water in the humidifying cavity 102 adheres to the surface of the supporting shell 9 to form a water film through a plurality of supporting holes formed in the supporting shell 9. Under the vibration of the ultrasonic plates 18, combined with the heating effect generated by the connecting coiled pipe 2 and the heat exchanging sheets 19, the contact effect between humidifying water and heat is increased, and the release amount of humidifying steam is increased.

In an embodiment, a partition plate 20 is fixedly connected in the humidifying box 1, and the humidifying box 1 is separated into the flocculating cavity 101 and the humidifying cavity 102 by the partition plate 20. The partition plate 20 has a heat conduction structure. Heat exchanging sheets 19 are fixedly connected to one side of the partition plate 20 close to the humidifying cavity 102, and the supporting shell 9 is arranged corresponding to the heat exchanging sheets 19, and the connecting coiled pipe 2 is arranged at the top of the supporting shell 9.

The connecting coiled pipe 2 extends into the humidifying cavity 102 to heat the humidifying cavity 102 in advance, which enhances the humidifying efficiency. At the same time, because the connecting coiled pipe 2 is arranged at the top of the humidifying cavity 102, when the steam in the humidifying cavity 102 is released, the residual steam rises to the top of the humidifying cavity 102, which effectively slows down the condensation amount of the steam in the humidifying cavity 102 under the heating and heat preservation effect of the connecting coiled pipe 2, thereby reducing the energy consumption required for secondary heating the condensed steam to form humidifying steam, further improving the heat exchange and humidifying efficiency and ensuring economic benefits.

In an embodiment, one side of the humidifying cavity 102 away from the heat exchanging sheets 19 is provided with a humidifying hole, and a filter plate 21 is fixedly connected in the humidifying hole. A water filling inlet is arranged at the bottom end of the humidifying cavity 102, and a water replenishing pipe 22 is communicated in the water filling inlet.

In the technical scheme, the ultrasonic plates 18 are arranged in the humidifying cavity 102, and the vibration is transmitted to the side wall of the humidifying box 1 through the ultrasonic plates 18, so that the filter plate 21 guides the released humidifying steam, improves the humidifying coverage area, and at the same time, the filter plate 21 absorbs the vibration to generate resonance to prevent impurities from adhering to the filter plate 21 to block the humidifying holes, thereby prolonging the service life of the whole humidifier.

Figure 7:
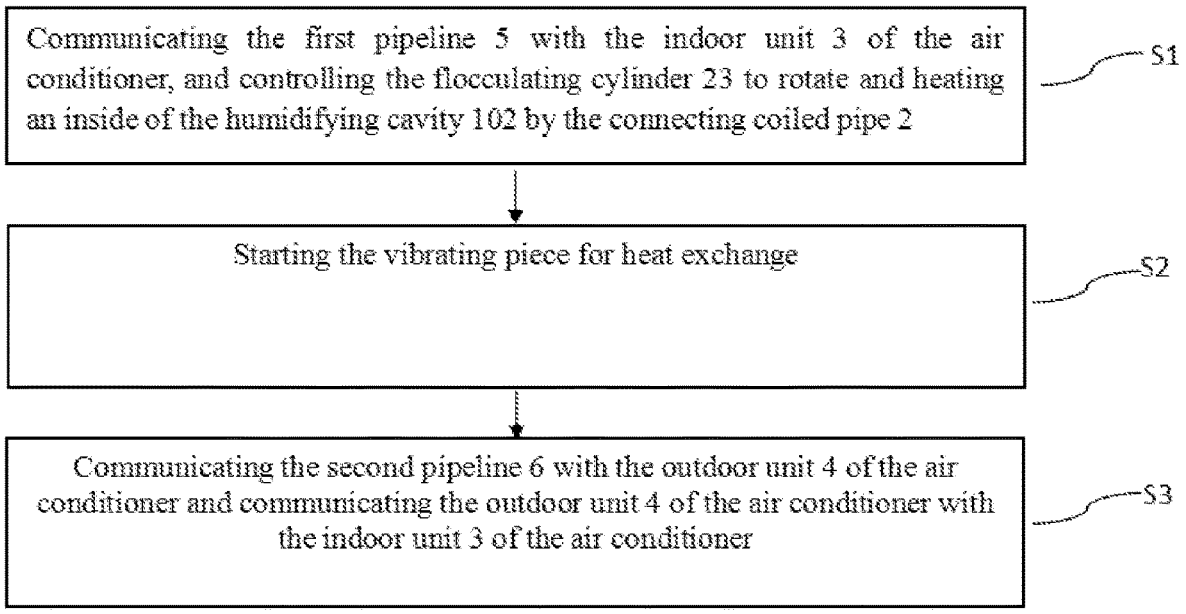
FIG. 7 is a process of a humidifying method for an air-conditioning unit when an air-conditioning unit refrigerates.

As shown in FIG. 7, a humidifying method for an air-conditioning unit, based on the humidifying device for the air-conditioning unit further includes the following steps when the air-conditioning unit refrigerates:

S1, communicating the first pipeline 5 with the air-conditioner indoor unit 3, and controlling the flocculating cylinder 23 to rotate and heating an interior of the humidifying cavity 102 by the connecting coiled pipe 2;

S2, starting the vibrating piece for heat exchange; and

S3, communicating the second pipeline 6 with the air-conditioner outdoor unit 4 and communicating the air-conditioner outdoor unit 4 with the air-conditioner indoor unit 3.

Figure 8:
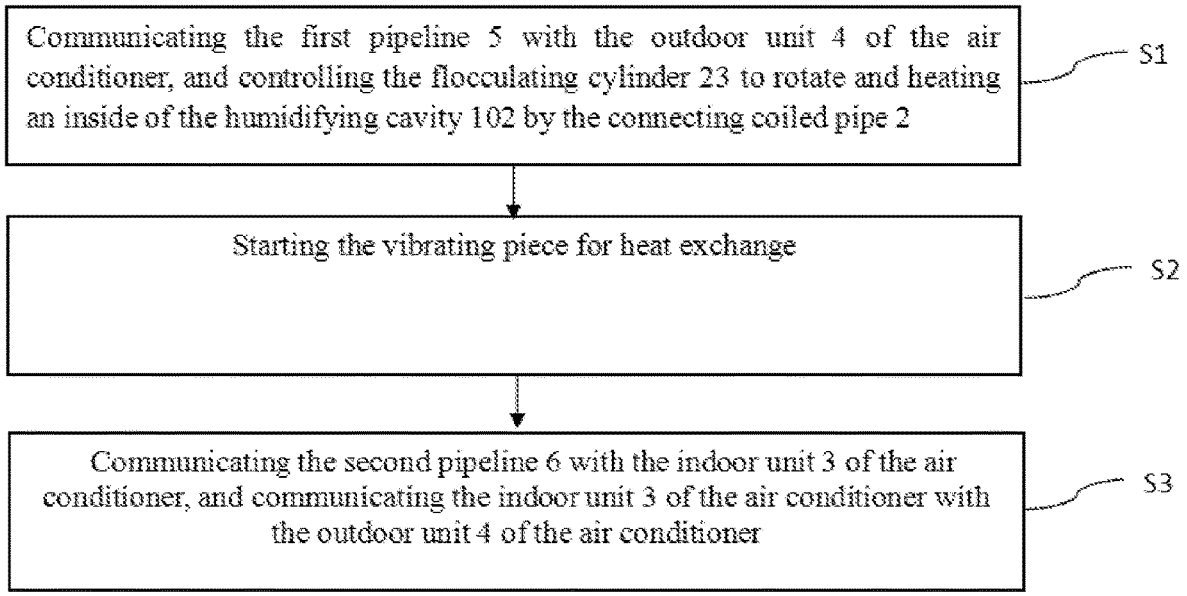
FIG. 8 is a process of a humidifying method for an air-conditioning unit when an air-conditioning unit heats.

In an embodiment, as shown in FIG. 8, a humidifying method for an air-conditioning unit, based on the humidifying device for the air-conditioning unit further includes the following steps when the air-conditioner heats:

S1, communicating the first pipeline 5 with the air-conditioner outdoor unit 4, and controlling the flocculating cylinder 23 to rotate and heating an interior of the humidifying cavity 102 by the connecting coiled pipe 2;

S2, starting the vibrating piece for heat exchange; and

S3, communicating the second pipeline 6 with the air-conditioner indoor unit 3, and communicating the air-conditioner indoor unit 3 with the air-conditioner outdoor unit 4.

By arranging a reversing valve 8 at joint of the first pipeline 5, the air-conditioner indoor unit 3, air-conditioner outdoor unit 4, and the second pipeline 6, the corresponding communication relationship of the humidifying box 1 is adjusted according to the refrigerating and heating modes of the air-conditioner, and the corresponding high-temperature and high-pressure gas is introduced into the connecting coiled pipe 2, so as to ensure the actual function of heat exchange and humidification of the humidifying box 1.

In the description of the present application, it should be noted that the orientation or position relationships indicated by the terms "longitudinal", "transverse", "upper", "lower", "front", "rear", "left", "right", "vertical", "horizontal", "top", "bottom", "inner", "outer" are based on the orientation or position relationships shown in the figures, which are only for the convenience of describing the present application, rather than indicating or implying that the device or elements must be in designated orientation, or configured or operated in designated orientation so that they cannot be understood as the limitation of this application.

The above-mentioned embodiments only describe the preferred mode of the present application, and do not limit the scope of the present application. Without departing from the design spirit of the present application, all kinds of modifications and improvements made by ordinary technicians in the field to the technical scheme of the present application should fall within the protection scope determined by the claims of the present application.

What is claimed is:

1. A humidifying device for an air-conditioning unit, comprising:

a humidifying box, wherein a flocculating cavity and a humidifying cavity are respectively defined in the humidifying box;

a connecting piece arranged in the humidifying cavity, wherein the connecting piece comprises a connecting coiled pipe fixedly connected to an inner wall of a top end of the humidifying cavity, an air inlet end of the connecting coiled pipe extends out of the humidifying cavity to be selectively communicated with an air-conditioner indoor unit or an air-conditioner outdoor unit, and an air outlet end of the connecting coiled pipe extends into the flocculating cavity;

a flocculating piece arranged in the flocculating cavity, wherein the flocculating piece comprises a flocculating cylinder rotatably connected with the flocculating cavity, the flocculating cylinder is provided with a plurality of flocculating holes, and one end of the connecting coiled pipe extending into the flocculating cavity is in transmission connection with the flocculating cylinder; and a heat exchanging piece arranged in the humidifying cavity, wherein the heat exchanging piece is used for exchanging heat between the humidifying cavity and the flocculating cavity, and the heat exchanging piece comprises a supporting shell fixedly connected in the humidifying cavity, and the supporting shell is provided with a plurality of supporting holes, and a vibrating piece is arranged in the supporting shell.

2. The humidifying device for the air-conditioning unit according to claim 1, wherein one end of the connecting coiled pipe extending out of the humidifying cavity is communicated with a first pipeline, and a compressor is arranged on the first pipeline, wherein the first pipeline is communicated with the air-conditioner indoor unit when the air-conditioning unit refrigerates, and the first pipeline is communicated with the air-conditioner outdoor unit when the air-conditioning unit heats.

3. The humidifying device for the air-conditioning unit according to claim 2, wherein a side of the flocculating cavity away from the connecting coiled pipe is provided and communicated with a second pipeline, and one end of the second pipeline extends out of the flocculating cavity, wherein when the first pipeline is communicated with the air-conditioner indoor unit, the second pipeline is communicated with the air-conditioner outdoor unit, and when the first pipeline is communicated with the air-conditioner outdoor unit, the second pipeline is communicated with the air-conditioner indoor unit.

4. The humidifying device for the air-conditioning unit according to claim 2, wherein a rotating rod is rotatably connected in the flocculating cavity, the flocculating cylinder is fixedly connected to the rotating rod, the rotating rod is provided with a transmission piece corresponding to the connecting coiled pipe, and the transmission piece comprises a plurality of spiral blades fixedly connected to the rotating rod in a circumferential direction, the air outlet end of the connecting coiled pipe faces the spiral blades, and a cleaning piece is also arranged in the flocculating cavity, and the cleaning piece is in sliding contact with the flocculating cylinder.

5. The humidifying device for the air-conditioning unit according to claim 4, wherein the cleaning piece comprises sleeves sleeved on the rotating rod, one end of each of the sleeves is connected with a control piece in a transmission way, each of the sleeves selectively reciprocates or rotatably rotates with the rotating rod through the control piece, and outer peripheral sides of the sleeves are in sliding contact with the flocculating cylinder.

6. The humidifying device for the air-conditioning unit according to claim 1, wherein the supporting shell adopts a columnar structure with a trapezoidal cross section, the plurality of supporting holes are arranged sequentially on both sides of a top end face of the supporting shell, the vibrating piece comprises a plurality of ultrasonic plates fixedly connected in the supporting shell, and the plurality of ultrasonic plates are arranged in sequence in a direction perpendicular to the rotating rod, and a gap is arranged between two adjacent ultrasonic plates.

7. The humidifying device for the air-conditioning unit according to claim 1, wherein a partition plate is fixedly connected in the humidifying box, and the humidifying box is separated into the flocculating cavity and the humidifying cavity through the partition plate, the partition plate is of a heat conduction structure, heat exchanging sheets are fixedly connected to one side of the partition plate close to the humidifying cavity, the supporting shell is correspondingly arranged with the heat exchanging sheets, the connecting coiled pipe is arranged at a top of the supporting shell.

8. The humidifying device for the air-conditioning unit according to claim 7, wherein one side of the humidifying cavity away from the heat exchanging sheets is provided with a humidifying hole, a filter plate is fixedly connected in the humidifying hole, a water filling inlet is arranged at a bottom end of the humidifying cavity, and a water replenishing pipe is communicated in the water filling inlet.

9. A humidifying method for an air-conditioning unit, based on the humidifying device for the air-conditioning unit according to claim 1, further comprising following steps when the air-conditioning unit refrigerates:

S1, communicating a first pipeline with the air-conditioner indoor unit, and controlling the flocculating cylinder to rotate and heating an interior of the humidifying cavity by the connecting coiled pipe;

S2, starting the vibrating piece for heat exchange; and

S3, communicating a second pipeline with the air-conditioner outdoor unit and communicating the air-conditioner outdoor unit with the air-conditioner indoor unit.

10. The humidifying method for the air-conditioning unit according to claim 9, wherein the humidifying method further comprises following steps when the air-conditioning unit heats:

S1, communicating the first pipeline with the air-conditioner outdoor unit, and controlling the flocculating cylinder to rotate and heating the interior of the humidifying cavity by the connecting coiled pipe;

S2, starting the vibrating piece for heat exchange; and

S3, communicating the second pipeline with the air-conditioner indoor unit, and communicating the air-conditioner indoor unit with the air-conditioner outdoor unit.

* * * * *